US011751607B2

(12) United States Patent
Ouyang

(10) Patent No.: US 11,751,607 B2
(45) **Date of Patent: *Sep. 12, 2023**

(54) ATOMIZING DEVICE OF AN ELECTRONIC CIGARETTE AND AN ELECTRONIC CIGARETTE

(71) Applicant: HONG KONG IVPS INTERNATIONAL LIMITED, Central (HK)

(72) Inventor: Junwei Ouyang, Shenzhen (CN)

(73) Assignee: Hong Kong IVPS International Limited, Central (HK)

( * ) Notice: Subject to any disclaimer, the term of this patent is extended or adjusted under 35 U.S.C. 154(b) by 399 days.

This patent is subject to a terminal disclaimer.

(21) Appl. No.: 17/016,444

(22) Filed: Sep. 10, 2020

(65) Prior Publication Data

US 2021/0076740 A1 Mar. 18, 2021

(51) Int. Cl.

| | |
|---|---|
| ***A24F 40/46*** | (2020.01) |
| ***A24F 40/42*** | (2020.01) |
| ***A24F 40/48*** | (2020.01) |
| ***A24F 40/40*** | (2020.01) |
| ***A24F 40/10*** | (2020.01) |

(52) U.S. Cl.

CPC ..... *A24F 40/46* (2020.01); *A24F 40/10* (2020.01); *A24F 40/40* (2020.01); *A24F 40/42* (2020.01); *A24F 40/48* (2020.01)

(58) Field of Classification Search

CPC ..... A24F 40/485; A24F 40/30; A24F 40/40; A24F 40/42; A24F 40/46

USPC ..... 131/329

See application file for complete search history.

(56) References Cited

U.S. PATENT DOCUMENTS

| | | | | |
|---|---|---|---|---|
| 9,877,521 | B1 * | 1/2018 | Gillis | A24F 47/008 |
| 11,612,187 | B2 * | 3/2023 | Ouyang | A24F 40/485 |
| 2019/0037920 | A1 * | 2/2019 | Qui | H05B 1/0227 |
| 2019/0166914 | A1 * | 6/2019 | Qiu | |

(Continued)

FOREIGN PATENT DOCUMENTS

| | | | | |
|---|---|---|---|---|
| CN | 110051044 A | * | 7/2019 | A24F 47/008 |

OTHER PUBLICATIONS

EP3725173A1, Ouyang, Junwei—used as English translation for CN110051044A (Year: 2020).*

*Primary Examiner* — Michael J Felton
*Assistant Examiner* — Ronnie Kirby Jordan
(74) *Attorney, Agent, or Firm* — Thompson Hine LLP

(57) ABSTRACT

The present disclosure discloses an atomizing device of an electronic cigarette that includes an atomizing base and an atomizing core component. The atomizing core component is configured to produce heat energy to atomize juice and is removably installed on the installation space along the insertion port of the atomizing base. When the atomizing core component is installed, the first part of the atomizing core component is plugged into the installation space, and the second part of the atomizing core component is configured to block the insertion port and at least part of the second part is exposed to the outside. When an external force is applied to the atomizing core component, the atomizing core component is configured to be pulled out along the insertion port driven by the at least part of the second part of the atomizing core component that is exposed to the outside.

16 Claims, 6 Drawing Sheets

(56) References Cited

U.S. PATENT DOCUMENTS

2020/0060343 A1* 2/2020 Tan et al. ..... A24F 40/42
2021/0378297 A1* 12/2021 Beer et al. ..... A24F 15/015

* cited by examiner

ATOMIZING DEVICE OF AN ELECTRONIC CIGARETTE AND AN ELECTRONIC CIGARETTE

CROSS-REFERENCE TO RELATED APPLICATION

This application claims priority to Chinese Patent Application No. 201921540734.3, filed on Sep. 12, 2019. The disclosure of the foregoing application is incorporated herein by reference in its entirety.

FIELD OF THE DISCLOSURE

The present disclosure relates to an atomizing device of electronic cigarette and an electronic cigarette using thereof.

BACKGROUND OF THE DISCLOSURE

Electronic cigarette, also called e-cigarette, is mainly used to quit smoking and replace traditional cigarettes. It has similar appearance and similar taste as traditional cigarettes, and even has more flavors than traditional cigarettes. It can also be smoked, tasted, and feel like traditional cigarettes. Electronic cigarettes are gradually replacing traditional cigarettes in the market because they are free of tar, suspended particulates, and other harmful components had in traditional cigarette. Small electronic cigarettes are portable, so they are very popular.

However, the atomizing device of traditional electronic cigarette usually adopts a closed cartridge, and the entire atomizing device will be discarded after the internal tobacco-juice is exhausted, resulting in high cost and environmental pollution. Therefore, atomization devices with replaceable internal atomizing core components are gradually developed; however, the internal atomizing core component is inconvenient for installation and disassembling because it is usually assembled and fixed with screw thread.

SUMMARY OF THE DISCLOSURE

The main purpose of the present disclosure is to provide an atomization device for electronic cigarettes, which is designed to facilitate users to replace the atomizing core component.

In order to achieve the above purpose, the present disclosure discloses an atomizing device of electronic cigarette, which comprises an atomizing base provided with a tobacco-juice storage cavity and an atomizing core component for producing heat energy for atomizing tobacco-juice, which is characterized in that the atomizing base is further provided with an installation space with an insertion port, and the atomizing core component is removably installed on the installation space along the insertion port;

When the atomizing core component is installed on the atomizing base, a first part of the atomizing core component will be plugged into the installation space, and a second part of the atomizing core component will block the insertion port; in addition, at least part of the second part will be exposed outside;

Under the action of external force, the atomizing core component may be pulled out along the insertion port driven by the part of the atomizing core component that is exposed outside.

In some implementations, the atomizing base is further provided with an air duct. When the atomizing core component is installed on the atomizing base, the first part will be elastically interference-plug into the air duct, which makes the internal air of atomizing core component communicate with the internal air channel of the air duct;

The second part is elastically interference-fit with the inner wall at the insertion port of the atomizing base, so that the atomizing core component can be fixed on the installation space.

In some implementations, either the first part or the air duct is provided with a first seal to elastically attach to the other one. A second seal is provided either the second part or inner wall of the air duct, so as to elastically attach to the other one.

In some implementations, the first seal and the second seal are in ring shape, and the first part and the second part are in columnar shape; the first seal and the second seal are pre-sleeved on peripheral surface of the first part and the second part.

In some implementations, spacing grooves corresponding to the first seal and the second seal are provided on the first part and the second part, respectively. Inner loop surfaces of the first seal and the second seal are sleeved in the spacing grooves, and outer loop surfaces are protruding out of the first part and the second part, respectively, and elastically abut against the air duct and inner wall of the insertion port.

In some implementations, the diameter of the first part is smaller than the inner diameter of the air duct, and the outer diameter of the first seal is larger than the inner diameter of the air duct;

The diameter of the second part is smaller than the diameter of the insertion port, and the outer diameter of the second seal is larger than the outer diameter of the insertion port.

In some implementations, first part and the second part are in columnar shapes. The diameter of protruding end of the first part decreases gradually from the end close to the second part to the end away from the second part, so as to form a guide part; and/or, the first part is arranged in cylindrical shape.

In some implementations, the first part and the second part are in columnar shape. A limit edge is further provided on the end of the second part towards outside, and the diameter of the limit edge is larger than the diameter of the insertion port.

In some implementations, a reinforcing rib is further provided at the outer side of the edge of the insertion port on the atomizing base, and/or the reinforcing rib is further provided at the inner side of the edge of the insertion port on the atomizing base.

In some implementations, the atomizing base comprises a cupped seat body and a partition board. The partition board is fixed on the cupped seat body and divides the space inside the cupped seat body into an internal space and a support space towards outside;

When the insertion port is provided on the partition board, and the atomizing core component is installed on the atomizing base, the first part will be elastically interference-plugged into the atomizing base, sand aid second part elastically interference will block the insertion port; in addition, part of the second part will protrude into the support space to form a holding part.

In some implementations, the plane, on which the convex end face of the holding part locates, is lower than the end face that cup mouth of the cupped seat body locates on, or flushes with the end face that cup mouth of the cupped seat body locates on.

In some implementations, a buckle groove is further provided on the side wall of the holding part towards the interior of the holding part.

In some implementations, the holding part comprises a bottom plate, a top plate that is relatively spaced with the bottom plate, and a connector that connects the bottom plate and the top plate; the buckle groove is formed between the top plate and the bottom plate.

In some implementations, the buckle groove communicates with the internal air way of the atomizing core component; or, a third par is further provided between the first part and the second part on the atomizing core component. When the atomizing core component is installed inside the installation space, the third part will communicate with the juice storage cavity.

The present disclosure further provides an electronic cigarette, which is characterized in that the electronic cigarette comprises a power supply unit and the atomizing device of electronic cigarette; the power supply unit is used to supply power to the atomizing device. The atomizing device comprises an atomizing base provided with a tobacco juice storage cavity and an atomizing core component for producing heat energy for atomizing tobacco-juice, which is characterized in that the atomizing base is further provided with an installation space with an insertion port, and the atomizing core component is removably installed on the installation space along the insertion port;

When the atomizing core component is installed on the atomizing base, a first part of the atomizing core component will be plugged into the installation space, and a second part of the atomizing core component will block the insertion port; in addition, at least part of the second part is exposed to the outside;

Under the action of external force, the atomizing core component may be pulled out along the insertion port driven by the part of the atomizing core component exposed outside.

In the atomizing device of electronic cigarette, the technical scheme of the present disclosure, an installation space is provided on an atomizing base and communicates with an installation space; the atomizing core component is removably installed in the installation space along the insertion port. When the atomizing core component is installed on the atomizing base, one end will be elastically interference-plugged inside the installation space, and the other end will block the insertion port to fix the atomizing core component in the atomizing base. When the user needs to replace the atomizing core component, he only needs to apply force to the part of the atomizing core component exposed outside to pull it out. No rotation or other driving control parts is required, which is easy to install and disassemble.

BRIEF DESCRIPTION OF THE DRAWINGS

For a more complete understanding of the present disclosure, or the technical schemes in the prior art, the drawings in the embodiments or the description of the prior art are briefly introduced. Obviously, the drawings in the following description are only some embodiments of the present disclosure, and it will be apparent to those skilled in the art from this disclosure that other drawings may be easily obtained from these drawings without paying any creative effort.

DEFINITION OF REFERENCE NUMBERS

Figure 1:
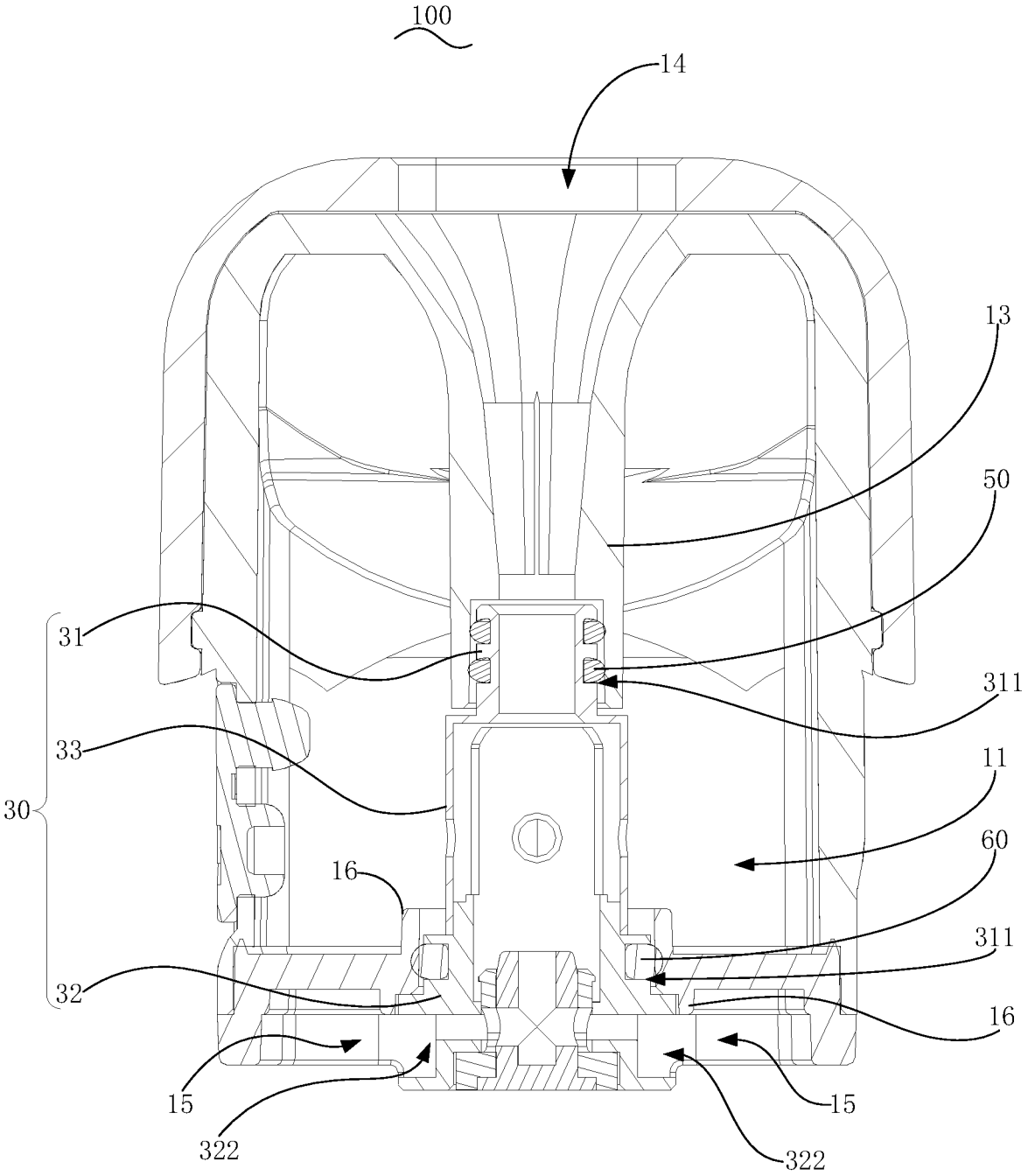
FIG. 1 is the schematic diagram of sectional structure of the connection of the atomizing device of electronic cigarette in the present disclosure.

| Reference Number | Name | Reference Number | Name |
|---|---|---|---|
| 10 | atomizing base | 11 | juice storage cavity |
| 12 | insertion port | 13 | air duct |
| 14 | suction port | 15 | escape groove |
| 16 | reinforcing rib | 17 | cupped seat body |
| 18 | partition board | 19 | positioning block |
| 30 | atomizing core component | 31 | first part |
| 32 | second part | 33 | the third part |
| 50 | the first seal | 60 | The second seal |
| 100 | atomizing device | 111 | installation space |
| 171 | cup mouth | 311 | spacing groove |
| 312 | guide part | 321 | limit edge |
| 322 | buckle slot | 323 | air inlet hole |
| 324 | holding part | 325 | positioning groove |
| 3241 | bottom plate | 3242 | connector |
| 3243 | top plate | | |

The realization of the objects, functional characteristics, and advantages of the present disclosure will be further described in conjunction with the embodiments and with reference to the drawings.

DETAILED DESCRIPTION OF EMBODIMENT

Technical solutions based on embodiments of the present disclosure are described clearly and completely in conjunction with the drawings in the embodiments of the present disclosure hereinafter. Apparently, the described embodiments are only a few but all the embodiments of the present disclosure. Other embodiments obtained by those skilled in the art without any creative work based on the embodiments of the present disclosure fall within the scope of protection of the present disclosure.

It should be noted that all directional indicators (such as up, down, left, right, front, back, etc.) in the embodiments of the present disclosure are only used to explain the relative position between the components in a specific posture (as shown in the drawings) and movement conditions, etc.; if the specific posture changes, the directional indication will also changes accordingly.

In the description of the present application, the "first" and "second" are merely used for description but cannot be understood to be any indication or implication relative to importance or implicit indication of the number of indicated technical features. Therefore, features with a limitation of "first" or "second" can explicitly or implicitly include one or more the feature. Furthermore, technical schemes of various embodiments can be combined with each other if only it can be implemented by those of ordinary skill in the art. If a combination of the technical schemes is conflict or impracticable, the combination should be considered as not exist and not fall in the scope of protection of the present disclosure.

In the present disclosure, unless otherwise clearly stated and limited, terms "connect" and "fix" should be understood broadly; for instance, "fix" can be a fixed connection, a detachable connection, or an integral connection; can be a mechanical connection or an electrical connection; can be a direct connection or an indirect connection by an intermediary; can be an internal communication of two elements, unless otherwise clearly limited. A person skilled in the art can understand concrete meanings of the terms in the present disclosure as per specific circumstances.

The present disclosure discloses an electronic cigarette. The electronic cigarette comprises an atomizing device 100 and a power supply unit that supplies electric power for the atomizing device 100. An installation cavity for inserting the atomizing device 100 is provided on the power supply unit, and an output electrode is provided in the installation cavity; the atomizing device 100 will establish electrical connection to the power supply unit through the output electrode when the atomizing device 100 is installed inside the installation cavity.

Refer to FIG. 1 to FIG. 6, in the present disclosure, the atomizing device 100 comprises an atomizing base 10 and an atomizing core component 30. A tobacco-juice storage cavity 11 and a juice injection hole communicating with the tobacco-juice storage cavity 11 are provided in the atomizing base 10 for storing tobacco-juice. The atomizing base 10 is further provided with an installation space 111 with an insertion port 12; the installation space 111 could be part of the tobacco-juice storage cavity 11 or be arranged independently, then communicates with the tobacco-juice storage cavity through the tobacco-juice guide hole. In this embodiment, the installation space 111 is part of the tobacco-juice storage cavity 11.

Figure 3:
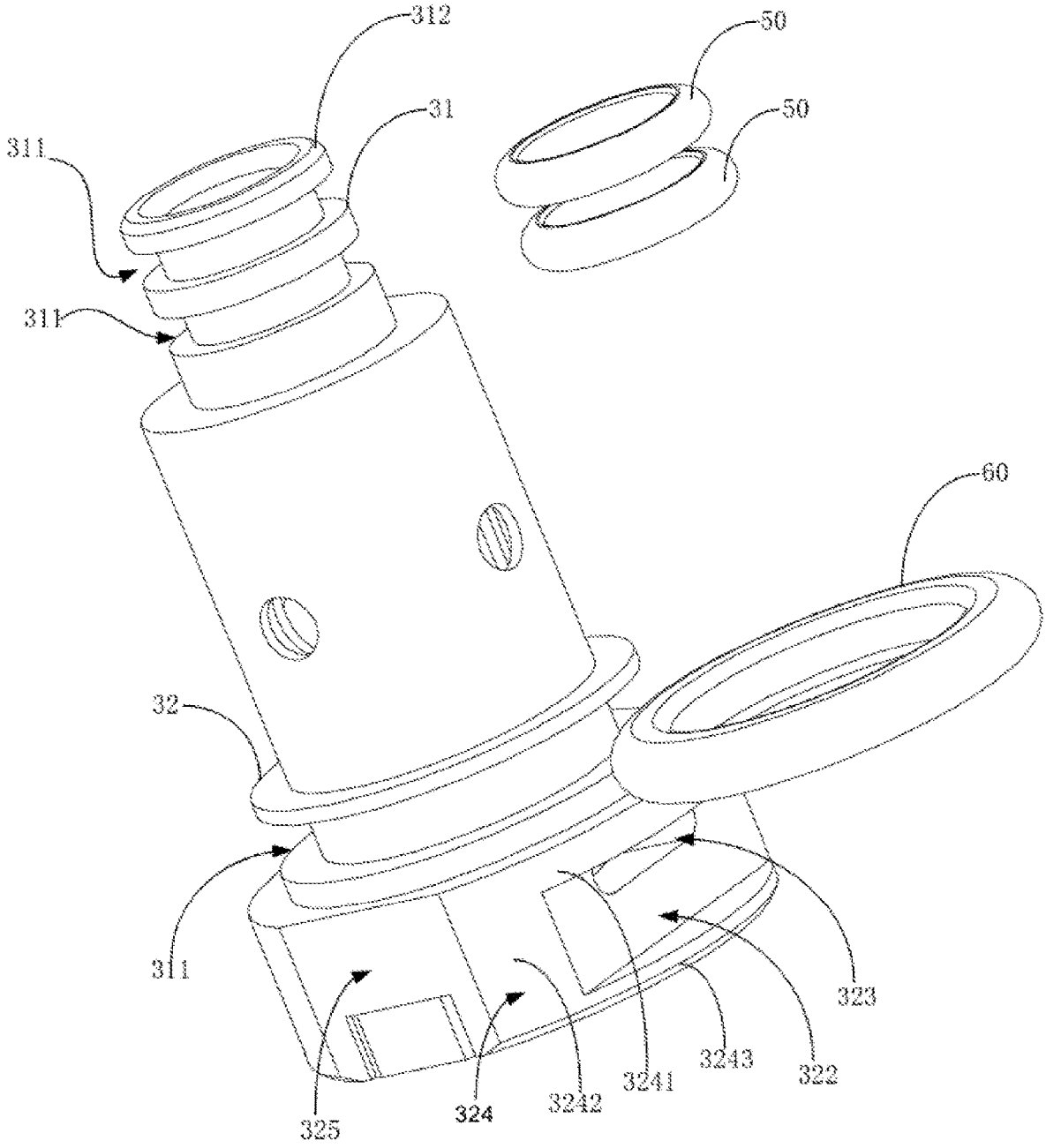
FIG. 3 is the exploded view of the connection structure of the atomizing core component, the first seal, and the second seal.
Figure 4:
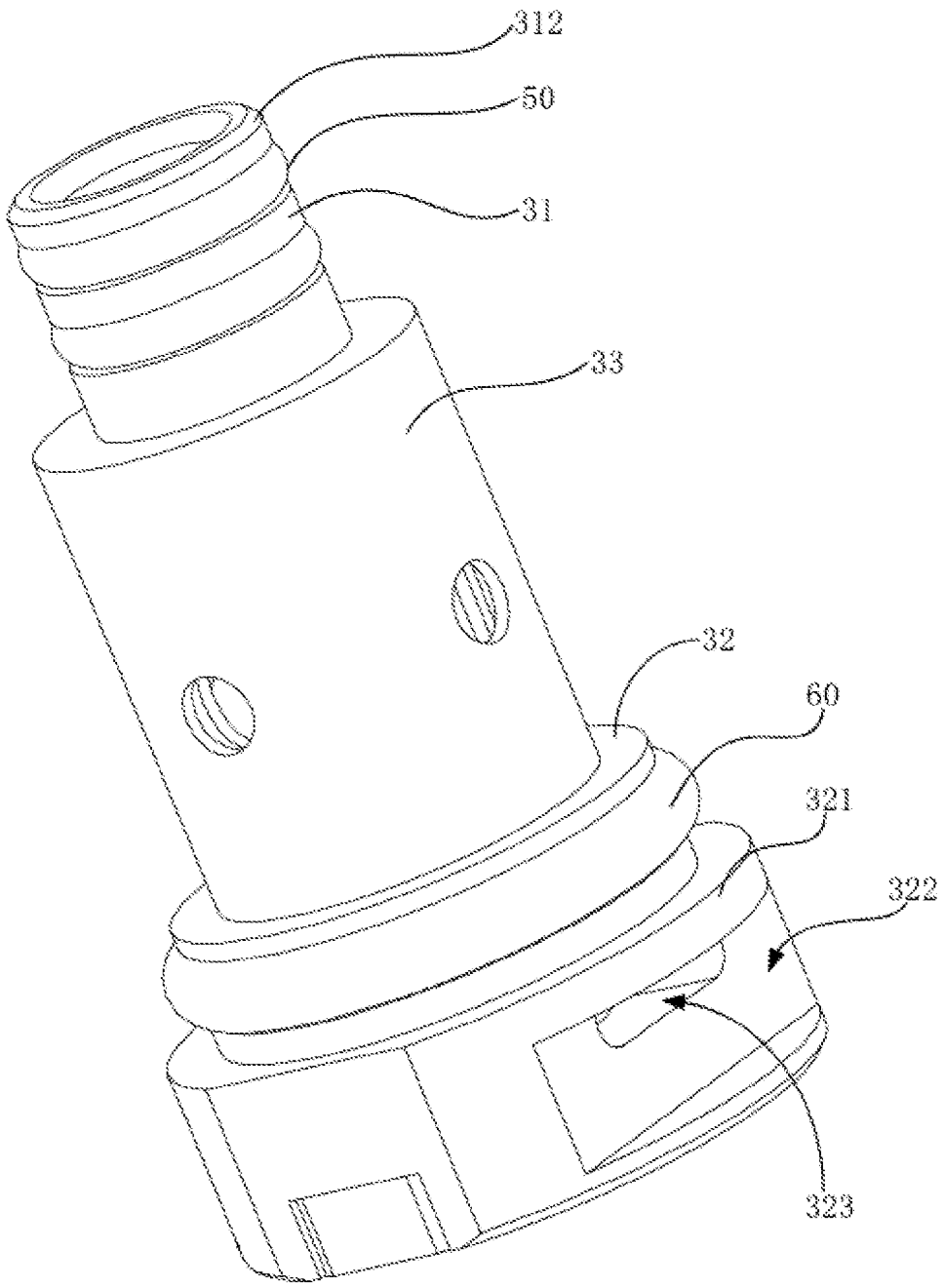
FIG. 4 is the stereo view of the connection structure when the first seal and the second seal are installed on the atomizing core component.
Figure 5:
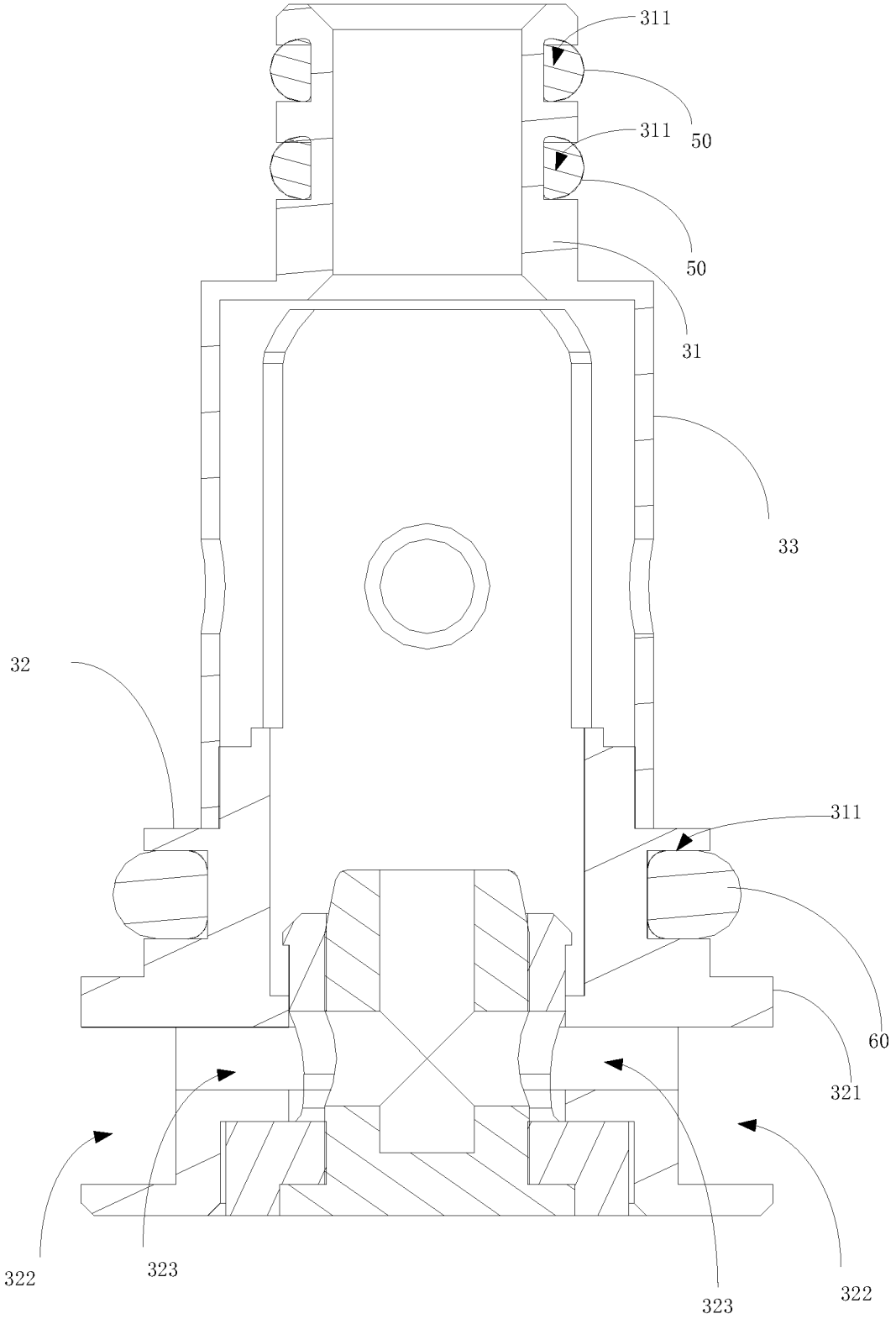
FIG. 5 is the section view of the connection structure of the atomizing core component in the present disclosure.

As shown in FIG. 3 to FIG. 5, in the present disclosure, the atomizing core component 30 comprises a first part 31, a second part 32, and a third part 33 between the first part 31 and the second part 32. The first part 31, second part 32, and third part 33 are all in columnar shape; and the outer diameters increase from the first part 31 to the third part 33 sequentially. An air duct 13 is further provided inside the installation space 111 on the atomizing base 10. When the user needs to install the atomizing core component 30, the first part 31 should be inserted into the air duct 13 along the insertion port 12 and elastically interference buckled on the inner wall of the air duct 13, so as to align the atomizing core component 30 with the atomizing base 10; the atomizing core component 30 communicates with the internal air way of the air duct 13. The atomizing core component 30 is further pushed into the installation space 111, so that the second part 32 with larger size can be elastically interference connected to the inner wall of the insertion port 12; at the same time, the third part 33 between the first part 31 and the second part 32 passes through the insertion port 12 and accommodates in the juice storage cavity 11. Furthermore, a plurality of passing juice orifices are provided on peripheral surface of the third part 33, so that juice in the juice storage cavity may flow into the atomizing core component 30 through the passing juice orifice to provide the juice required by atomization. Then, two ends of the atomizing core component 30 both are interference buckled on the atomizing base 10, as to fix the atomizing core component 30 on the installation space 111 provided on the atomizing base 10. At the same time, movement of the atomizing core component along the connection direction from the insertion port 12 to the air duct 13 is limited only by elastically interference buckle, but not locking mechanism or thread connection. Therefore, when the user applies an outward pull-out force to the atomizing core component 30, he will only need to overcome the friction and clamping force between the atomizing core component 30 and the atomizing base 10 directly and elastically, then the atomizing core component can be pulled out along the insertion port 12, which effectively facilitates the user to install or disassemble the atomizing core component 30 in the atomizing device 100. Then, the tobacco-juice can be injected into the juice storage cavity 11 through the juice injection hole. There is no need to replace the entire atomizing device 100, which effectively saves the use cost.

It should be understood that, in practice, it is not limited to the above-mentioned embodiment by providing the air duct 13 in the tobacco-juice storage cavity 11, and then elastically interference inserting the first part 31 to the air duct 13 achieve fixation. For example, in other embodiments of the present disclosure, an escape hole can be provided on the cavity wall of the tobacco-juice storage cavity 11 for the first part 31 to pass through, then provide a seal sleeve between the inner wall of the escape hole and the first part 31, so that the peripheral surface of the first part 31 and inner wall of the escape hole are elastically interference connected and sealed. The first part 31 may communicate with the air channel of suction port 14 after passing through the escape hole, which also fall in the protection scope of the disclosure.

Specifically, as shown in FIG. 1, in the present disclosure, either the first part 31 or the air duct 13 is provided with a first seal 50 to elastically attach to the other one. A second seal 60 is provided either the second part 32 or the inner wall of the air duct 13, so as to elastically attach to the other one. The first seal 50 and the second seal 60 can be made of elastic silicone, plastic, rubber, etc. In this embodiment, the first seal and the second seal are preferably made of elastic silicone material to avoid product damage caused by high temperature during atomization. At the same time, a spacing groove 311 is provided along the circumferential direction of the first part 31 to accommodate the first seal 50, and a spacing groove 311 is provided along the circumferential direction of the second part 32 to accommodate the second seal 60. The first seal 50 and the second seal 60 are in ring shape; when the first seal 50 and the second seal 60 are sleeved on the spacing groove 311 correspondingly, the inner loop surface will elastically abut against the inner wall of the spacing groove 311, and the outer loop surface will protrude out of the spacing groove 311. When the atomizing core component 30 is installed on the installation space 111, outer loop surfaces of the first seal 50 and the second seal 60 will elastically abut against the inner wall of corresponding air duct 13 and the inner wall at the insertion port 12 to achieve sealing.

It should be understood that, in practice, it is not limited to the above-described embodiment, wherein the first seal 50 and the second seal 60 are fixed through the spacing groove 311. For example, in other embodiments of the present disclosure, size of the first seal 50 and the second seal 60 could be designed larger to cover the peripheral surface of the first part 31 and the second part 32, or pre-installed at the air duct 13 and the insertion port 12 in T-shape or I-shape to ensure that peripheral surface of the first part 31 and the second part 32 is elastically sealed with the inner wall of the air duct 13 and the insertion port 12 when the atomizing core component 30 is installed on the installation space 111, so as to prevent leakage of tobacco-juice from the juice storage cavity 11 and effectively fix the atomizing core component 30 on the atomizing base through elastically interference buckling on upper and lower ends.

At the same time, in practice, quantity of the first seal 50 and the second seal 60 can be selected reasonably based on the size of product and consistent with the quantity of the spacing groove 311. For example, in the embodiment of the present disclosure, two the spacing grooves 311 are arranged on the first part 31 along the longitudinal direction of the first part, then the first seals 50 are installed in the two spacing grooves 311, respectively. During the installation is performed by user, two the first seals 50 are inserted into the air duct 13 one after the other. When one of the first seals 50 is inserted into the air duct 13, the outer loop surface of the first seal is elastically interference with the inner wall of the air duct 13 to generate a certain pushing resistance, so that the user can know the successful alignment through the feel of push. When further pushed in and the first seal 50 is interference-inserted into the air duct 13, the pushing resistance will increase. It may improve the feeling of hand to avoid too large pushing force or damage of internal structure of the atomizing base 10 under pressure. At the same time, when pushed to the second part 32, the second seal 60 is elastically interference-fit to the inner wall of the insertion port 12 of the atomizing base 10 to complete the installation.

Specifically, as shown in FIG. 1, in the embodiment of the present disclosure, the diameter of the first part 31 is smaller than the internal diameter of the air duct 13, and there is a distance between the first seal 50 and the protruding end surface of the first part 31. Therefore, when the first part 31 is inserted into the air duct 13, the first part will fit with the inner wall of the air duct 13, and no friction will be generated for easy insertion. At the same time, it further prevents the first part 31 from abutting against the second part 32 after inserted. In the embodiment of the present disclosure, the first part 31 is further designed as a cylindrical shape, so that the first part 31 can be inserted into the air duct 13 at any angle, and the diameter of the end of the first part 31 can gradually increase from the protruding end to the end that is close to the third part 33, so as to form a wedge or arc guide surface or form a guide part to facilitate the insertion of the first part. In the same way, the diameter of the air duct 13 gradually decreases from the end facing the insertion port 12 to the end far away from the insertion port 12, and the method of forming a guide surface also falls within the protection scope of the present disclosure.

It should be understood that, in the embodiment of present disclosure, the diameter of the second part 32 is smaller than the diameter of the insertion port 12 to facilitate insertion, and the outer diameter of the second seal 60 is larger than the diameter of the insertion port 12 to facilitate interference buckling. The advantage effects are consistent with those produced by the first part 31 and will not be repeated here.

Specifically, as shown in FIG. 1, in the embodiment of present disclosure, the second part protrude outside towards end of outside to form the limit edge 321 with larger diameter than the insertion port 12, which effectively prevents user from exerting too large pushing force or crushing the internal structure of the atomizing base 10.

It should be understood that, in practice, it is not limited to the above-described embodiment, wherein the limit edge 321 is provided on the second part 32 to limit the position through abutting against the edge of the insertion port 12. For example, in other embodiments of the present disclosure, a limit block can also be convexly provided on the side of the end of the second part 32, or the size of the third part 33 is larger than the diameter of the air duct 13. When the atomizing core component 30 is pushed to the third part 33 until the end convexly provided on the air duct 13 is contacted, the atomizing core component will abut and limit the position. Otherwise, a stop edge is provided on the inner wall of the air duct 13 abutting against the end of the first part 31, which falls in the protection scope of the present disclosure.

Figure 2:
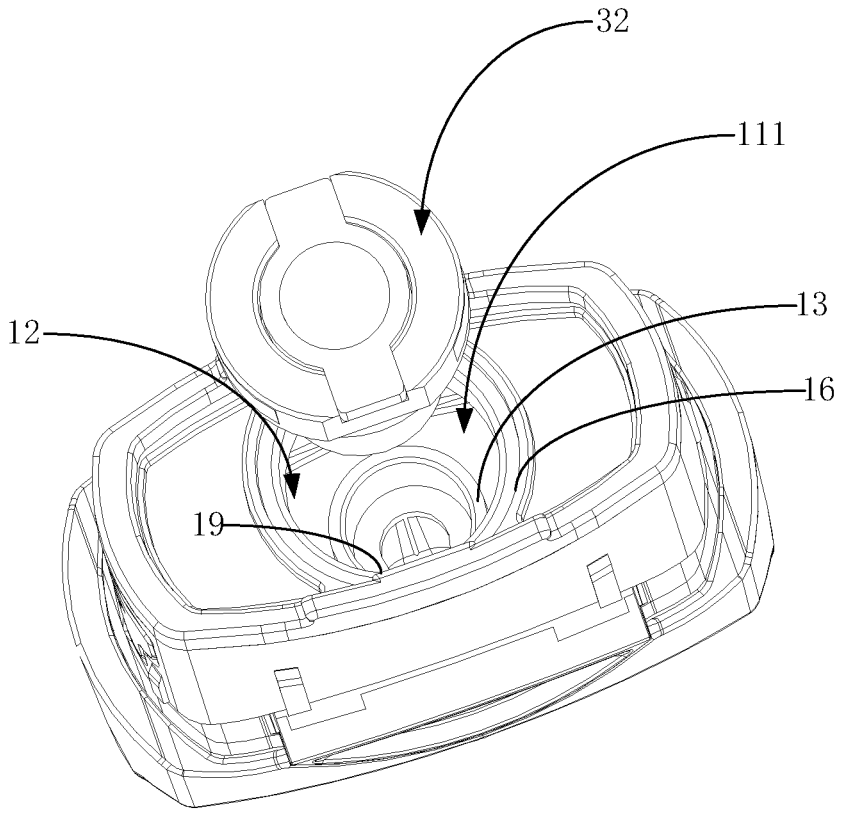
FIG. 2 is the exploded view of the connection structure of the atomizing core component when inserted along the insertion port of the atomizing base.
Figure 6:
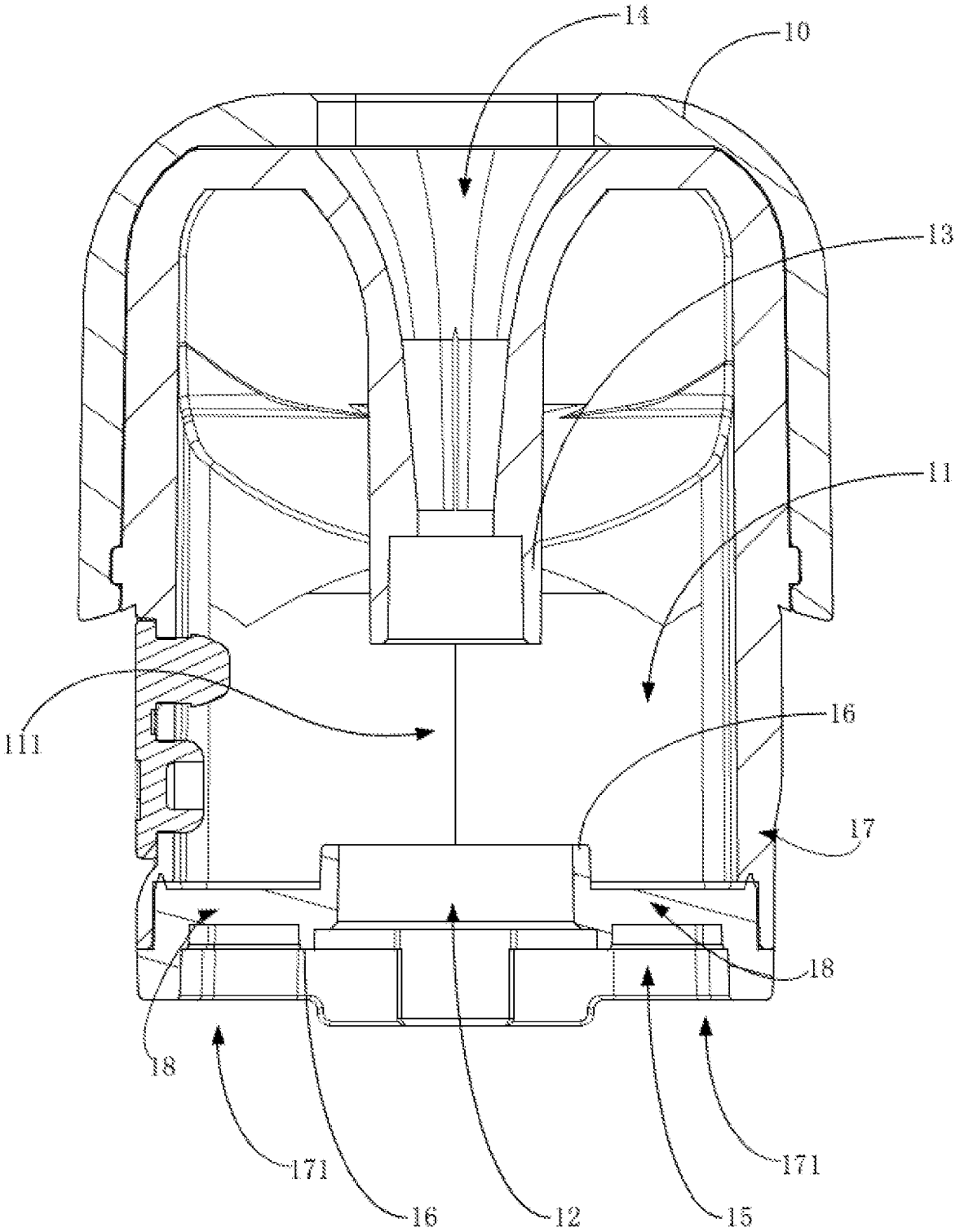
FIG. 6 is the section view of the connection structure of the atomizing base in the present disclosure.

Additionally, as shown in FIG. 1, FIG. 2, or FIG. 6, in the embodiment of present disclosure, it prevents the user from exerting a large pushing force and crushing the edge of the insertion port 12 of the atomizing base 10. In this embodiment, the atomizing base 10 is provided with the insertion port 12, and the inner and outer edges surround the insertion port 12 are both provided with reinforcing ribs 16 to enhance the structural strength at the insertion port 12 of the atomizing base 10. At the same time, the area of the insertion port 12 where directly opposite to the second part 32 is increased. Therefore, it is convenient for the user to design the installation position of the second seal 60 or design multiple sets of the second seal 60.

Furthermore, as shown in FIG. 1, FIG. 2 or FIG. 6, in the embodiment of the present disclosure, the atomizing base 10 is further provided with at least one escape groove 15 on the inner wall of the insertion port 12 to make part of the side wall of the second part 32 is exposed to the outside. When the user needs to disassemble the atomizing core component 30, the user can apply a force to the side wall of the second part 32 through the escape groove 15, so that the user can pull it out easily.

It should be understood that, in practice, the number of the escape groove 15 can be two, three, or more. In this embodiment, it is preferably two. The two escape grooves 15 are arranged opposite to each other, so that user may apply force on both sides of the second part 32, which also falls in the protection scope of the present disclosure.

Specifically, the atomizing base 10 comprises a cupped seat body 17 and a partition board 18. The partition board 18 is fixed on the cupped seat body 17 by ultrasonic process or interference fit and divides the space inside the cupped seat body 17 into an internal space and a support space towards outside. The juice storage cavity 11 is accommodated in the internal space, and the insertion port 12 is formed by said partition board 18. When the atomizing core component 30 is installed on the atomizing base 10, the first part 31 will be inserted into the atomizing base 10 along the insertion port 12 and elastically interference inserted into the air duct 13; the third part 33 passes through the insertion port 12, which is accommodated inside the internal space and communicates with the juice storage cavity 11. The second part 32 elastically interference blocks the insertion port 12, and part of the second part 32 protrudes into the support space to form a holding part 324; the space between the holding part 324 and inner wall of the cupped seat body 17 forms the escape groove 15. When the user needs to replace the atomizing core component 30, he only needs to hold the holding part 324 exposed in the supporting space and pull it out along the insertion port 12 to complete the disassemble process.

Specifically, the plane, on which the convex end face of the holding part 324 locates, is lower than the end face that the cup mouth 171 of the cupped seat body locates on, or flushes with the end face that the cup mouth 171 of the cupped seat body locates on. That is, the height that the holding part 324 protrudes out of the partition board is lower than or equal to the height that cup mouth 171 of the cupped seat body protrude out of the partition board 18, so that the atomizing core component 30 is accommodated inside the convex end face of the cup mouth 171. When a foreign object has a tendency to squeeze along the cup mouth 171 toward the atomizing core component 30, the cup mouth 171 exerts a supporting force on the foreign object, thereby effectively preventing the atomizing base 10 from being excessively squeezes by the atomizing core component 30 due to external forces when accommodating the atomizing device 100.

Furthermore, as shown in FIG. 1, or FIG. 3 to FIG. 5, in the embodiment of present disclosure, a buckle groove 322 is further provided on the second part 32 from the holding part 324 exposed on the escape groove 15 towards inside of the holding part 324. When the user disassembles the atomizing core component 30, fingers will pass through the escape groove 15 and be inserted into the buckle groove 322 provided in the second part 32, then exert a force on the inner wall of the buckle groove 322 directly opposing to the direction of the insertion port 12, so as to pull out the atomizing core component 30.

Specifically, the holding part 324 comprises a bottom plate 3241, a top plate 3243, and at least one connector 3242. The bottom plate 3241 is integrally molded with the body of the second part 32, and the top plate 3243 and the bottom plate 3241 are arranged with interval relatively. One end of the connector is fixed on the bottom plate 3241, and the other end is fixed on the top plate 3243; the connection method can be integrally molded or fixed by welding, so that the buckle groove 322 is formed between the top plate 3243 and the bottom plate 3241. When the user needs to pull out the atomizing core component 30 from the insertion port 12, he should insert his fingers between the bottom plate 3241 and the top plate 3243, and exert a force on the surface of the top plate 3243 towards the bottom plate 3241, so as to effectively prevent the tobacco-juice from remaining on the outer peripheral surface of the holding part 324 of the atomizing core component 30, resulting in slippery and inconvenient to hole when pulled out.

Furthermore, in order to avoid dislocation of the buckle groove 322 and the escape groove 15, in the embodiment of the present disclosure, a positioning groove 325 and a positioning block 19 may be provided in the second part 32 and the insertion port 12, respectively, so that the second part 32 is positioned and installed on the atomizing base 10 to ensure that the buckle groove 322 and the escape groove 15 are directly facing each other for easy disassembly by the user.

Furthermore, as shown in FIG. 1, or FIG. 3 to FIG. 5, in the embodiment of present disclosure, if the suction port 14 of the atomizing base 10 is blocked by a sealing plug, internal airflow cannot be discharged when the atomizing core component 30 is inserted into the installation space 111, resulting in poor insertion. Therefore, in the embodiment of present disclosure, an air inlet hole 323 is further provided on the middle part of the bottom plate 3241 of the buckle groove 322 to communicate with the internal airway of the atomizing core component 30. It should be understood that, when the atomizing core component 30 is installed on the installation space 111, pressure is usually applied to the end surface of the atomizing core component 30 away from the insertion port 12; therefore, the air inlet hole 323 is provided inside the buckle groove 322 of the second part 32, which will effectively prevent the air inlet hole 323 from being covered by fingers during pushed if the air inlet hole 323 is provided on end face of the atomizing core component 30. During the process of installation of the atomizing core component 30 by inserting it into the installation space 111 along the insertion port 12, the internal airflow in the atomizing base 10 can flow outside through the internal airway and the air inlet hole 323 of the atomizing core component 30. It is no need to pull out the seal of the suction port 14 during installation, which further facilitates the user to install or disassemble the atomizing core component 30.

It should be understood that, in the embodiment of present disclosure, to improve the stability of the connection between the top plate 3243 and the bottom plate 3241, a plurality of connector 3242 may be provided between the top plate 3243 and the bottom plate 3241 for connection. At the same time, the plurality of connectors 3242 are symmetrically arranged between the top plate 3243 and the bottom plate 3241 to ensure a more balanced force and avoid the air inlet hole 323.

It should be understood that, in practice, the present disclosure is not limited to arrange a plurality of connectors 3242 between the top plate 3243 and the bottom plate 3241. For example, in another embodiment of the present disclosure, a large size connector 3242 also can be provided on the middle part of the top plate 3243 and the bottom plate 3241, so as to fix the top plate 3243 and the bottom plate 3241. At this time, in order to prevent the air inlet hole 323 provided on the middle of the bottom plate 3241 from being covered by the connector 3242 provided on the middle part, in this embodiment, the air inlet hole 323 can be provided on other positions of the bottom plate 3241, or an air inlet passage can be provided inside the connector 3242. One end of the air inlet passage communicates with original air inlet hole 323 provided on the bottom plate 3241, and the other end forms a new air inlet hole 323 communicating with outside along with the side wall of the connector 3242, so as to achieve communication between the internal airway of the atomizing core component 30 and outside, which also falls in the protection scope of the present disclosure.

The present disclosure also discloses an electronic cigarette. The electronic cigarette comprises an atomizing device 100 and a power supply unit that supplies electric power for the atomizing device 100. The specific structure of the atomization device 100 refers to the above-mentioned embodiments. The electronic cigarette adopts all the technical schemes of all above embodiments, therefore it have at least all the beneficial effects brought by the technical schemes of the above embodiments, which will not be repeated here.

The above only describes preferred embodiments of the present disclosure and is not intended to limit the patent scope of the present disclosure. Any equivalent structural transformation made by using contents of the description and drawings of the present disclosure or directly or indirectly used in other relevant technical fields under the inventive concept of the present disclosure shall be included within the protection scope of patent of the present disclosure.

What is claimed is:

1. An atomizing device of an electronic cigarette, comprising:

an atomizing base that includes a tobacco-juice storage cavity and an installation space with an insertion port; and an atomizing core component comprising a first part and a second part, wherein the atomizing core component is configured to produce heat energy to atomize juice and is removably installed on the installation space along the insertion port of the atomizing base, wherein, when the atomizing core component is installed on the atomizing base, the first part of the atomizing core component is plugged into the installation space, and the second part of the atomizing core component is configured to block the insertion port and at least part of the second part is exposed to the outside, wherein, when an external force is applied to the atomizing core component, the atomizing core component is configured to be pulled out along the insertion port driven by the at least part of the second part of the atomizing core component that is exposed to the outside.

2. The atomizing device of claim 1, wherein the atomizing base further comprises an air duct, wherein when the atomizing core component is installed on the atomizing base, the first part is configured to plug into the air duct which makes the internal air of the atomizing core component communicate with the internal air channel of the air duct, and wherein the second part is configured to fit with an inner wall at the insertion port of the atomizing base, so that the atomizing core component is fixed on the installation space.

3. The atomizing device of claim 2, wherein the first part or the air duct comprises a first seal configured to elastically attach the first part to the air duct, wherein the second part or an inner wall of the air duct comprises a second seal configured to elastically attach the second part to the inner wall of the air duct.

4. The atomizing device of claim 3, wherein the first seal and the second seal comprise ring shapes, and the first part and the second part of the atomizing core component are in columnar shapes, wherein the first seal and the second seal are pre-sleeved on a peripheral surface of the first part and the second part.

5. The atomizing device of claim 4, wherein the first part and the second part each comprise spacing grooves corresponding to the first seal and the second seal, respectively, wherein inner loop surfaces of the first seal and the second seal are sleeved in the spacing grooves, and outer loop surfaces are protruding out of the first part and the second part, respectively, and elastically abut against the air duct and the inner wall of the insertion port.

6. The atomizing device of claim 3, wherein a diameter of the first part is smaller than an inner diameter of the air duct, and an outer diameter of the first seal is larger than an inner diameter of the air duct, wherein a diameter of the second part is smaller than a diameter of the insertion port, and an outer diameter of the second seal is larger than an outer diameter of the insertion port.

7. The atomizing device of claim 1, wherein the first part and the second part of the atomizing core component are in columnar shapes, and a diameter of a protruding end of the first part decreases gradually from an end which is closes to the second part to an end which is away from the second part, which forms a guide part, and the first part comprises a cylindrical shape.

8. The atomizing device of claim 1, wherein the first part and the second part of the atomizing core component comprise columnar shapes, wherein the second part comprises a limit edge on the end of the second part towards outside, and the diameter of the limit edge is larger than the diameter of the insertion port.

9. The atomizing device of claim 1, wherein the atomizing base further comprises a reinforcing rib at an outer side of an edge of the insertion port and at an inner side of the edge of the insertion port.

10. The atomizing device of claim 1, wherein the atomizing base further comprises a cupped seat body and a partition board fixed on the cupped seat body, wherein the partition board divides the space inside the cupped seat body into an internal space and a support space towards outside, wherein when the insertion port is on the partition board, and the atomizing core component is installed on the atomizing base, the first part is configured to be elastically interference-plugged into the atomizing base, and the second part is configured to be elastically interference-block the insertion port, wherein part of the second part protrudes into the support space to form a holding part.

11. The atomizing device of claim 10, wherein the holding part comprises a plane on a convex end face of the holding part that is lower than an end face of a cup mouth of a cupped seat body, or the holding part flushes with the end face of the cup mouth of the cupped seat body.

12. The atomizing device of claim 10, wherein the side wall of the holding part further comprises a buckle groove located on an interior of the holding part.

13. The atomizing device of claim 12, wherein the holding part comprises a bottom plate, a top plate that is relatively spaced with the bottom plate, and a connector that connects the bottom plate and the top plate; wherein the buckle groove is formed between the top plate and the bottom plate.

14. The atomizing device of claim 12, wherein the buckle groove is configured to communicate with an internal air way of the atomizing core component.

15. The atomizing device of claim 1, wherein the atomizing core component further comprises a third part located between the first part and the second part on the atomizing core component, wherein when the atomizing core component is installed inside the installation space, the third part is configured to communicate with the juice storage cavity.

16. An electronic cigarette, comprising:

a power supply unit; and an atomizing device, the atomizing device comprising:

an atomizing base that includes a tobacco-juice storage cavity and an installation space with an insertion port; and an atomizing core component comprising a first part and a second part, wherein the atomizing core component is configured to produce heat energy to atomize juice and is removably installed on the installation space along the insertion port of the atomizing base, wherein, when the atomizing core component is installed on the atomizing base, the first part of the atomizing core component is plugged into the installation space, and the second part of the atomizing core component is configured to block the insertion port and at least part of the second part is exposed to the outside, wherein, when an external force is applied to the atomizing core component, the atomizing core component is configured to be pulled out along the insertion port driven by the at least part of the second part of the atomizing core component that is exposed to the outside, wherein the power supply unit is configured to supply power to the atomizing device.

* * * * *